US005630467A

United States Patent [19]

Yoshimura et al.

[11] Patent Number: 5,630,467

[45] Date of Patent: May 20, 1997

[54] THIN SLAB CONTINUOUS CASTING MACHINE AND METHOD

[75] Inventors: Yasutsugu Yoshimura; Mituru Onose; Kenji Horii; Koichi Seki; Tadashi Nishino; Hironori Shimogama, all of Hitachi; Chukichi Hanzawa, Takahagi, all of Japan

[73] Assignee: Hitachi, Ltd., Tokyo, Japan

[21] Appl. No.: 536,259

[22] Filed: Sep. 29, 1995

[30] Foreign Application Priority Data

Sep. 30, 1994 [JP] Japan ..... 6-236882

[51] Int. Cl.[6] ..... B22D 11/12; B22D 11/20; B22D 11/124

[52] U.S. Cl. ..... 164/486; 164/444; 164/442; 164/455

[58] Field of Search ..... 164/459, 477, 164/417, 486, 444, 484, 442, 455

[56] References Cited

U.S. PATENT DOCUMENTS 4,420,029 12/1983 Kameyama ..... 164/417

*Primary Examiner*—Kuang Y. Lin

*Attorney, Agent, or Firm*—Antonelli, Terry, Stout & Kraus, LLP

[57] ABSTRACT

Guide roller units are made movable back and forth in the direction of thickness of a slab, allowing slab lagging covers to be inserted to and withdrawn from gaps formed between the guide roller units and the slab. Depending on the casting speed, those ones of the guide roller units and the slab lagging covers which are in proper positions are replaced from one to the other for selective use so that the respective lengths of a cooling zone and a heat keeping zone are adjusted to control the cooling rate of the slab in a positive manner. The slab temperature can be kept at a value capable of carrying out rolling regardless of change in the casting speed depending on variations in the amount of molten steel supplied.

6 Claims, 12 Drawing Sheets

THIN SLAB CONTINUOUS CASTING MACHINE AND METHOD

BACKGROUND OF THE INVENTION

The present invention relates to a continuous caster suitable for use in a hot rolling mill system in which steps from continuous casting to finish rolling are performed in a direct rolling manner, and more particularly to a thin slab continuous casting machine and method for continuously casting a thin slab with a thickness not greater than 100 mm.

About thirty years has passed since continuous casting was put to practical use, and most of slabs is now produced by the continuous casting. Heretofore, in consideration of quality, slabs with a thickness ranging from 200 mm to 250 mm (hereinafter referred to as thick slabs) have generally been produced by the continuous casting at a casting speed of 1.5 to 2.5 m/min (hereinafter referred to as first prior art).

Meanwhile, in the 1980's, a hot rolling mill system called a continuous casting—hot rolling—through line (or direct-feed) system, in which steps from continuous casting to finish rolling are performed through one line in a direct rolling manner, has been developed. As a result, taking into account the total production efficiency, a thin slab continuous caster capable of producing slabs with a thickness ranging from 30 mm to 100 mm (hereinafter referred to as thin slabs) is developed.

A hot rolling mill system (hereinafter referred to as second prior art) described in "Ein Jahar Betriebserfahrung mir der CSP-Anlage fuer Warumbreitband bei Nucor Steel"; Stahl u. Eisen, 111 (1991) Nr. 1, for example, is basically arranged such that a slab is directly fed from a continuous caster to a roughing mill. Exactly speaking, however, a slab is not continuously fed from the continuous caster to the roughing mill, but after being cut off into pieces with a length of 20 m to 50 m. Thus, since a slab is cut off into pieces between the continuous caster and the roughing mill, the casting speed and the rolling speed can be set independently of each other, meaning that the rolling speed can be increased regardless of the casting speed. Further, this prior art is premised on using steel molten by an electronic furnace (hereinafter referred to as electronic furnace steel) and can perform casting at a substantially constant speed under control of the amount of molten steel supplied.

Also, in a hot rolling mill system (hereinafter referred to as third prior art) described in "ISP-Thin slab challenge to Nucor"; Steel Times, Oct. 1993, a slab is not cut off between a continuous caster and a roughing mill, but continuously fed therebetween. In this system, however, a strip is once reeled up into a coil between the roughing mill and a finishing mill. Since the strip is unreeled from the coil in which the strip temperature is kept from lowering and then fed to the finishing mill, the rolling speed in the finishing mill can also be increased regardless of the casting speed. Further, as with the above second prior art, since this prior art is premised on using electronic furnace steel, it is possible to easily adjust the amount of molten steel supplied and to hold the casting speed substantially constant without considerable variations.

On the other hand, as disclosed in JP, A, 62-64462, there is known a technique for cooling and solidifying a slab in continuous casting with an arrangement that reheating and controlled cooling are selectively switched over in a cooling zone below a mold (hereinafter referred to as fourth prior art). More specifically, controlled cooling means is disposed in part of a non-solidified reheating zone, which is provided as a cooling region, to thereby establish a zone where controlled cooling can be performed. When the casting speed is fast, the controlled cooling means is actuated under control for cooling a cast slab, and when the casting speed is slow, only the nonsolidified reheating is effected without carrying out the controlled cooling. Thus, the cooling rate is controlled depending on the casting speed so that the temperature of a cast slab is kept at a desired value. Also, it is considered to adjust the cooling rate so that the crater end of a cast slab reaches substantially the same position as the end of a continuous caster or enters the caster.

SUMMARY OF THE INVENTION

While the casting speed is as low as 1.5 to 2.5 m/min, the first prior art is generally premised on the condition that the cast slab is cut off into pieces which are left to cool down naturally and then heated again for a certain period of time to a predetermined temperature before the rolling. Therefore, even if the casting speed is slow and the slab is cooled down too much, there is no problem in manufacture because solidification of the slab is only expedited. Accordingly, a technical care required with regard to the casting speed is the need to set the length of the cooling region below the mold to match with the maximum casting speed. Anyway, since the casting speed is slow and the slab temperature is lowered too much, the first prior art cannot produce a thin slab (thickness of 30 mm to 100 mm) at a temperature capable of carrying out rough rolling in order to achieve a through line process from the continuous casting to the finish rolling.

In the second and third prior arts, since a thin slab with a thickness of 30 mm to 100 mm is produced, the casting speed is required to be as high as possible for ensuring a production rate comparable to that achieved in conventional systems. But if the casting speed is too fast, the powder supplied to the mold fails to develop its capability. Accordingly, there is a limit in increasing the casting speed to achieve stable casting. On the other hand, if the casting speed is too slow, the slab temperature is so reduced that the slab cannot be directly subjected to rough rolling. Thus, it is also essential to set a lower limit on the casting speed. Stated otherwise, if the casting speed of a thin slab with a thickness of 30 mm to 100 mm is set to the range of 1.5 to 2.5 m/min as with the above first prior art in order that the slab is directly fed from the continuous caster to the roughing mill, the slab is cooled down too much in the cooling region and cannot be rolled as it is because of an excessive reduction in its temperature. To avoid this situation, the slab must be heated again for a short period of time before the rough rolling, which eventually results in energy loss. Therefore, the second and third prior arts are not adaptable for a casting speed as low as 1.5 to 2.5 m/min employed in the first prior art. For the above reasons, the casting speed in the second and third prior arts are usually set to the range of 3 to 6 m/min.

To perform the casting while holding the casting speed in the above-mentioned range, the second and third prior arts are both premised on using electronic furnace steel which can be molten and supplied in a control led amount. This is because an electronic furnace can control the amount of molten steel and also enables intermittent operation to be carried out for each unit amount of molten steel so that the casting speed in the continuous casting is kept as constant possible in the range of 3 to 6 m/min. As a result, the extent that the slab is cooled down during the casting will not change largely, and the slab temperature can always be kept substantially constant on the entry side of the roughing mill.

However, because an electronic furnace has a difficulty in producing high-grade products such as materials for deep drawing, there has recently arisen a demand for a thin slab continuous caster using molten steel (hereinafter referred to as blast furnace—converter steel) which is produced by refining molten iron from a blast furnace into steel by a converter. In medium- and small-scaled iron mills many of which produce steel in various grades and small quantity, the production schedule is usually affected by demands varying for each grade of steel, and the amount of blast furnace—converter molten steel charged varies largely, for example, from 80 ton/hr to 300 ton/hr. Such a variation in the amount of molten steel supplied may bring about an event that the continuous casting operation must be suspended temporarily if the casting speed is to be kept constant as explained above.

In realizing a future hot rolling mill system in which steps from continuous casting to finish rolling are performed in a through line, it is very important to be able to accommodate variations in the amount of molten steel supplied, as resulted when the blast furnace—converter steel is used, without suspending the continuous casting operation, and to maintain the slab temperature regardless of change in the casting speed within a certain range where the slab can be subjected to the rough rolling.

While the above fourth prior art is to control the cooling rate depending on the casting speed so that the slab temperature is held at a desired value, this prior art is basically directed to conventional thick slabs, but it is not intended for producing thin slabs not thicker than 100 mm. In the fourth prior art, because of the slab having a relatively large thickness on the order of 200 mm to 250 mm and being less apt to cool down, if the controlled cooling is not effected in the cooling region, the effect of reheating is sufficiently expected when the casting speed is slow. In other words, since the thermal capacity of the slab results relatively great, a sufficient degree of reheating is just by ceasing or stopping the controlled cooling in the non-solidified reheating zone. However, when the fourth prior art is applied to production of such thin slabs as intended by the present invention, there is a fear that, because of thin slabs having a relatively small thermal capacity, the slab may be too cooled down too much and the slab temperature may be reduced excessively during passage through the non-solidified reheating zone while the controlled cooling is stopped. The slab suffering from such an excessive reduction in its temperature cannot be directly subjected to the rough rolling, as explained above. This tendency is particularly remarkable when the casting speed is slow. Further, since the cooling region is disposed horizontally in the fourth prior art, the extent that the slab is cooled down is different between the upper and lower sides thereof, making it difficult to hold even temperature of the cast slab over its cross-section, particularly in the direction of thickness.

An object of the present invention is to provide a thin slab continuous casting machine and method by which the slab temperature can be kept at a value capable of carrying out rolling regardless of change in the casting speed depending on variations in the amount of molten steel supplied.

To achieve the above object, according to the present invention, there is provided a thin slab continuous casting machine comprising a mold for casting molten metal and a secondary cooling region for cooling and solidifying a slab cast in the mold while feeding the cast slab, thereby continuously casting a slab with a thickness not larger than 100 mm, wherein the secondary cooling region consists of a plurality of sections, and at least one of the sections includes a guide roller unit equipped with cooling spray comprising guide rollers for feeding the slab and cooling sprays for cooling the slab, a slab lagging cover for preventing a temperature drop of the slab, and replacement means for selectively replacing the guide roller unit equipped with cooling spray and the slab lagging cover from one to the other.

In the above thin slab continuous casting machine, preferably, the slab is fed along a vertical straight line from the mold to the lower end of the secondary cooling region.

Also, preferably, the guide roller unit equipped with cooling spray and the slab lagging cover are replaced from one to the other for selective use during the casting operation.

In the above thin slab continuous casting machine, preferably, the replacement means includes back-and-forth moving means for moving at least part of the guide rollers of the guide roller unit back and forth in the direction of thickness of the slab, and inserting/withdrawing means for inserting the slab lagging cover to a gap formed between the slab and the part of the guide rollers which is moved back by operation of the back-and-forth moving means, and withdrawing the slab lagging cover from the gap.

In the above, more preferably, the guide roller unit equipped with cooling spray includes pinch rollers disposed in positions out of interference with the slab lagging cover and coming into contact with the slab so that the pinch rollers can feed the slab while pressing the slab without interfering with the back-and-forth movement of the slab lagging cover, and free rollers movable by the back-and-forth moving means back and forth in the direction of thickness of the slab.

Preferably, the replacement means further includes withdrawing means for withdrawing at least one of the guide roller unit and the slab lagging cover to the work side or the drive side when the secondary cooling region is under maintenance work or not in use.

To achieve the above object, according to the present invention, there is further provided a thin slab continuous casting method comprising the steps of casting molten metal in a mold, and cooling and solidifying a cast slab in a secondary cooling region while feeding the cast slab through said secondary cooling region, thereby continuously casting a slab with a thickness not larger than 100 mm, wherein the secondary cooling region consists of a plurality of sections, and at least one of the sections includes a guide roller unit equipped with cooling spray comprising guide rollers for feeding the slab and cooling sprays for cooling the slab, and a slab lagging cover for preventing a temperature drop of the slab, the guide roller unit and the slab lagging cover being replaced from one to the other for selective use depending on the casting speed to adjust a cooling rate of the slab so that the slab temperature is kept constant just before rough rolling regardless of the casting speed.

The amount of blast furnace—converter steel supplied varies for each charge or for units of several charges. The casting speed must be changed depending on such variations, and this change is required to be made even during the continuous casting operation in a simple and quick manner. For example, if the amount of molten steel supplied is reduced, it is required to lower the casting speed. Generally, a continuous caster includes guide rollers provided with cooling sprays for conveying a slab of which a surface layer has been solidified by a mold into a predetermined cross-sectional shape, while cooling and solidifying the slab so that a core portion of the slab is solidified. The portion of the continuous caster which includes the guide rollers is called a secondary cooling region. When the casting speed is lowered, the length over which the slab is conveyed in the secondary cooling region until it is solidified is shortened correspondingly. In this case, if the purpose of the secondary cooling region is only to solidify the slab, the change in conditions can be accommodated just by stopping the cooling effected in a part of the secondary cooling region because the cooling in that part is no longer needed. In a continuous casting—hot rolling—through line (or direct-feed) system, however, the slab delivered from the continuous caster is fed to the entry side of a roughing mill at the same speed while being cooled down naturally. Accordingly, when the casting speed is slow, the temperature of a thin slab not thicker than 100 mm is lowered too much and cannot be maintained at a value capable of carrying out the rough rolling as a next successive step.

The relationship between the casting speed and the slab temperature will be described below in more detail.

Generally, the relationship between the slab thickness and the cooling time in continuous casting are expressed by the following equation:

$$D = K\sqrt{\Delta t} = K\sqrt{\frac{L}{V}} \tag{1}$$

where

D: half of the slab thickness

Δt: cooling time

K: coefficient (=25)

L: cooling distance, i.e., metallurgical length v: casting speed

From the equation (1), the cooling distance L, i.e., the metallurgical length, is expressed below:

$$L = v \cdot \left(\frac{D}{K}\right)^2 \tag{2}$$

As will be seen from the equation (2), if the casting speed v is changed with the slab thickness being kept the same, the metallurgical length L is also changed in proportion. Thus, as the casting speed v is reduced, the metallurgical length L is shortened.

Supposing a slab with a thickness of 70 mm, by way of example, when the casting speed is 4 m/min on condition that only usual guide rollers provided with cooling sprays are employed in the secondary cooling region, the metallurgical length from the meniscus required for solidifying the slab until its core portion, i.e., the metallurgical length $L_4$ required for achieving the core temperature of 1490° C., is given below:

$$L_4 = 4 \times \left(\frac{35}{25}\right)^2 = 7.84\ (m) \tag{3}$$

On the other hand, if the casting speed v is lowered to 1.5 m/min, the metallurgical length $L_{1.5}$ from the meniscus required for solidifying the slab until its core portion is given below:

$$L_{1.5} = 1.5 \times \left(\frac{35}{25}\right)^2 = 2.94\ (m) \tag{4}$$

Accordingly, if cooling after the casting is continued until the position of $L_4$=7.84 (m) from the meniscus when the casting speed is lowered to 1.5 m/min, the slab is cooled down excessively corresponding to the length of $L_4$–$L_{1.5}$= 4.9 (m) and, hence, the core temperature of the slab is remarkably reduced to 728° C. It is generally desired from the standpoint of metallography that a slab be rolled at about 1100° C. in the first pass of the rough rolling. Therefore, the slab of which core temperature has been reduced as mentioned above cannot be subjected to the rough rolling as it is.

Even if the cooling is stopped at the position of $L_{1.5}$=2.94 (m) and, thereafter, the slab is left to cool down naturally over the length of $L_4$–$L_{1.5}$=4.9 (m), the core temperature of the slab is 1133° C. and the surface temperature thereof is about 1000° C. In consideration of natural heat dissipation (such as by descaling) until the first pass of the rough rolling, the slab cannot also be subjected to the rough rolling as it is.

By contrast, in the present invention, when the casting speed is slow on the order of 1.5 m/min as with the above case, for example, the slab temperature is prevented from reducing over the distance from the position of $L_{1.5}$=2.94 (m) to the position of $L_4$=7.84 (m) from the meniscus so that the first pass of the rough rolling after the continuous casting can be performed at a proper temperature of 1100° C. or thereabout.

More specifically, in the thin slab continuous casting machine of the present invention constructed as set forth above, the guide roller unit equipped with cooling spray, which comprises the guide rollers and the cooling sprays, and the slab lagging cover for preventing a temperature drop of the slab are provided in at least one section of the secondary region. The cooling guide roller unit and the slab lagging cover are replaced from one to the other for selective use. Therefore, the cooling rate of the slab can be controlled in a positive manner by adjusting the respective lengths of a cooling zone and a heat keeping zone in the secondary cooling region depending on the casting speed. In addition, the replacement between the two members can be made simply and quickly. Accordingly, the temperature of the slab just before the rough rolling can be held at a substantially constant value capable of carrying out the rough rolling. In particular, when the casting speed is slow, the heat of the slab is positively kept by the slab lagging cover and, therefore, the temperature of the slab is prevented from reducing to an excessively low value at which the rough rolling cannot be performed.

For example, by replacing the guide roller unit equipped with cooling spray, which is provided in a position of the secondary cooling region remote from the mold, by the slab lagging cover, an excessive temperature drop of the thin slab can be prevented even when the casting speed is lowered. In other words, even when the casting speed is reduced from a high speed not lower than 5 m/min to a low speed on the order of 1.5 m/min, the slab temperature can be kept substantially constant at the outlet of the continuous caster and, hence, a next rolling step can be performed with no problems.

Also, in the present invention, the caster is arranged such that the slab is fed along a vertical straight line from the mold to the lower end of the secondary cooling region. It is therefore possible to prevent the extent that the slab is cooled down from differing in a cross-section of the slab, and to hold the temperature of the slab even over its cross-section, unlike the case that the path of the slab is set, e.g., horizontally.

Further, the guide roller unit and the slab lagging cover are replaced from one to the other for selective use during the casting operation. Therefore, when the casting speed is changed depending on variations in the amount of molten steel supplied during the continuous casting operation, the cooling rate of the slab can be controlled simply and quickly by adjusting the respective lengths of the cooling zone and the heat keeping zone.

When selectively replacing the guide roller unit and the slab lagging cover from one to the other, at least part of the guide rollers is moved by the back-and-forth moving means back and forth in the direction of thickness of the slab, and the slab lagging cover is inserted to the gap formed between the slab and the part of the guide rollers which is moved back by operation of the back-and-forth moving means, or withdrawn from the gap. This insertion and withdrawal of the slab lagging cover can be performed by the inserting/withdrawing means.

The guide roller unit includes pinch rollers and free rollers. The pinch rollers are disposed in positions out of interference with the slab lagging cover and coming into contact with the slab so that the pinch rollers can feed the slab while pressing the slab without interfering with the back-and-forth movement of the slab lagging cover. On the other hand, the free rollers are movable by the back-and-forth moving means back and forth in the direction of thickness of the slab. The gap to which the slab lagging cover is inserted is formed between the free rollers and the slab.

When the secondary cooling region is under maintenance work or not in use, the guide roller unit or the slab lagging cover can be withdrawn or removed to the work side or the drive side by the withdrawing means. The above inserting/withdrawing means can double as the withdrawing means.

Furthermore, the use of the thin slab continuous casting machine of the present invention makes it possible to carry out the thin slab continuous casting method of present invention by which the guide roller unit and the slab lagging cover are replaced from one to the other for selective use depending on the casting speed to adjust the cooling rate of the slab so that the slab temperature is kept constant Just before the rough rolling regardless of the casting speed.

DETAILED DESCRIPTION OF THE PREFERRED EMBODIMENTS

One embodiment of a thin slab continuous casting machine and method according to the present invention will be described below with reference to FIGS. 1 to 12.

Figure 1:
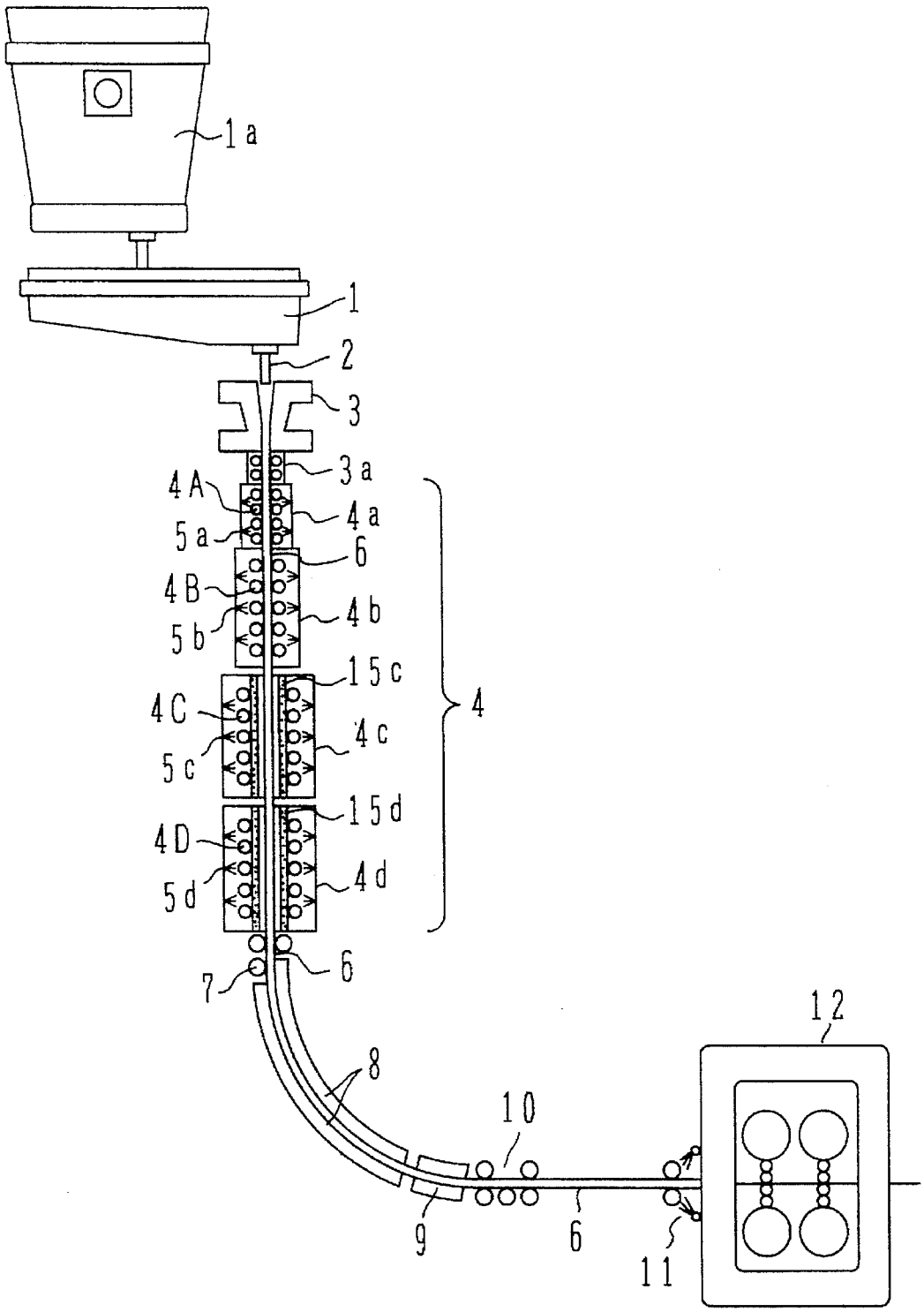
FIG. 1 is a schematic view of a thin slab continuous casting machine (caster) according to one embodiment of the present invention, the view showing a general layout of the caster.

FIG. 1 schematically shows a general layout of the thin slab continuous casting machine (caster) of the embodiment. Molten steel once accumulated in a tundish 1 by a ladle 1*a* is charged into a mold 3 through a tundish nozzle 2. The molten steel is gradually solidified from the surface in the mold 3 so that a solidified shell having a desired slab shape is formed. A slab 6 having passed the mold 3 is fed to a secondary cooling region 4 through foot rollers 3*a* just below the mold 3. The secondary cooling region 4 comprises four sets of guide roller units equipped with cooling spray, i.e. units 4*a* to 4*d*. These guide roller units 4*a* to 4*d* include respectively guide rollers 4A to 4D for conveying the slab 6, and cooling water nozzles 5*a* to 5*d* disposed between adjacent twos of the guide rollers 4A to 4D for spraying water or a mixture of water and air to cool the slab 6. While moving through the secondary cooling region 4, the slab 6 is cooled down and gradually solidified until its core portion. Incidentally, the secondary cooling region 4 may be divided into sections in any suitable number other than four.

The guide roller units 4*a* to 4*d* are movable toward or away from the slab 6 in the direction of slab thickness, as described later, so that slab lagging covers formed of a heat insulating material can be inserted to or withdrawn from gaps between the slab 6 and the guide rollers 4A to 4D. Although two of the slab lagging covers are not shown in FIG. 1 as being not inserted in place, they can be inserted to respective positions in front of the guide roller units 4*a* and 4*b* as shown by the positions of covers 15*c* and 15*d* in front of guide roller units 4*c* and 4*d*, if necessary.

The slab 6 having passed the cooling spray equipped guide roller units 4*a* to 4*d* is bent by a bending roller 7 at its leading end, passes between curved section slab lagging covers 8, and is then heated again by an edge heater 9 at its edge portions where the temperature has relatively been lowered. After that, the curved slab 6 is reformed into a straight shape by a straightener 10 and then introduced to a roughing mill 12. The curved section slab lagging covers 8 are formed of a heat insulating material for preventing heat dissipation from the surface of the slab 6 while it is curving for change in the direction to advance. A body heater may be used instead of the edge heater 9. Further, a descaler 11 is disposed at the entry of the roughing mill 12 for removing scales caused on the slab surface during the slab cooling step.

Note that, as shown in FIG. 1, the caster is arranged such that the slab is fed along a vertical straight line from the mold 3 to the lower end of the secondary cooling region 4.

Prior to considering the detailed description of the embodiment, results of study on the solidification process and the basic concept of the present invention based on the study results will be described below with reference to FIGS. 2 to 4. For comparison, results of study on the case that only the guide roller units 4*a* to 4*d* are provided in the secondary cooling region 4 with the slab lagging covers omitted in FIG. 1, will first be described.

Figure 2:
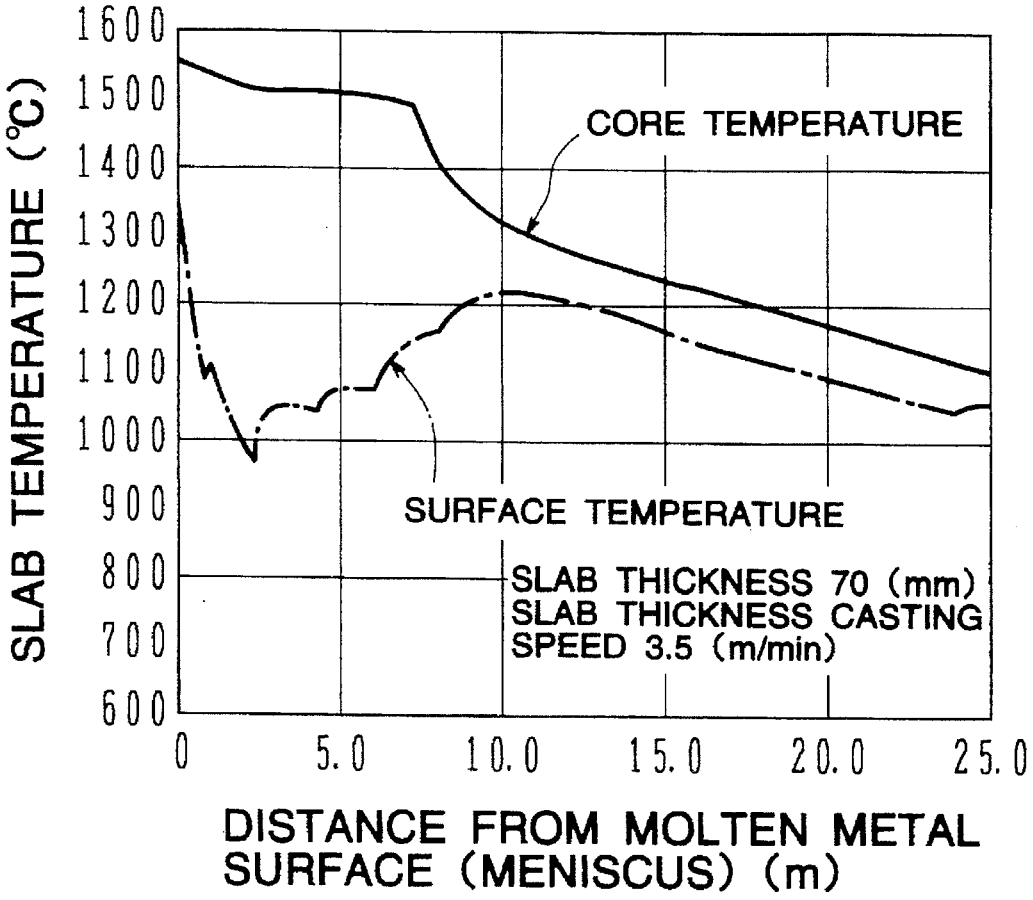
FIG. 2 is a graph showing simulation results of the surface temperature and the core temperature of a slab on condition that the slab thickness is 70 mm and the casting speed is 3.5 m/min.

FIG. 2 is a graph showing simulation results of the surface temperature and the core temperature of the slab on condition that the slab thickness is 70 mm and the casting speed is 3.5 m/min. Note that, in FIG. 2, the distance from the molten metal surface (hereinafter referred to as meniscus) in the mold 3 is represented by the horizontal axis. Since the slab 6 enters the secondary cooling region 4 just after exiting the mold 3 (at the position distanced 7.5 m from the meniscus), the core temperature of the slab 6 is gradually lowered from that position of 7.5 m. On the other hand, the surface temperature of the slab 6 is abruptly lowered at the beginning because the molten steel is cooled down to form a solidified shell from the surface in the mold 3, but a little raised in the secondary cooling region due to heat dissipation from the core portion of the slab, and thereafter is gradually lowered as with the core portion.

Figure 3:
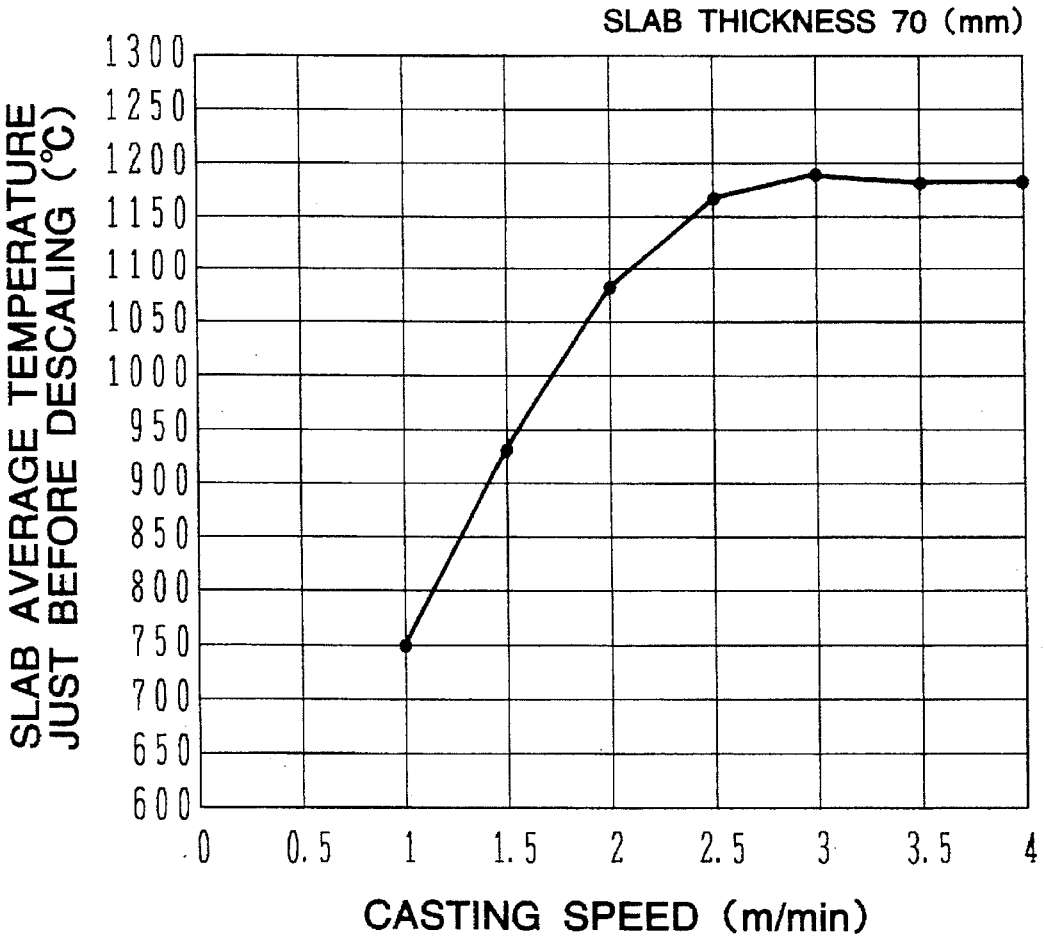
FIG. 3 is a graph showing the slab average temperature at the position of 16.9 m from the meniscus when the casting speed is changed.

FIG. 3 is a graph showing the average temperature of the slab 6 at the position of 16.9 m from the meniscus, i.e., at the position of the descaler 11 just before the roughing mill 12, when the casting speed is changed. For the molten steel having a temperature of 1550° C. at the meniscus, the slab average temperature is 1182° C. at the position of 16.9 m from the meniscus when the casting speed is 4 m/min. If the casting speed is lowered to 1.5 m/min, on the other hand, average temperature of the slab at the position of 16.9 m from the meniscus is about 930° C., as will be seen from FIG. 3, because the slab is too much cooled down too much while passing through the sections of the cooling spray equipped guide roller units 4*a* to 4*d*. Further, the slab temperature after the descaling is about 40° to 50° C. lower than the above temperature (930° C.). From the viewpoint of quality of hot strips, the slab temperature of about 1100° C. is required to carry out the first pass of the rough rolling in order that hot strips have sound material properties free from any defects. If the slab having such a low temperature as mentioned above is subjected to the rough rolling, not only desired material quality cannot be obtained, but also an adverse effect of causing cracks in the slab edge portions is resulted.

Judging from FIG. 3, when the casting speed is not lower than 3 m/min, the slab temperature of about 1100° C. is obtained on the entry side of the roughing mill 12 after the descaling, taking into account a temperature drop of about 40° to 50° C. due to the descaling as well. However, when the casting speed is not higher than 3 m/min, the slab temperature is abruptly lowered.

The reason why the slab temperature on the entry side of the roughing mill 12 is lowered to a large extent when the casting speed is slow, as mentioned above, is attributable to that the length of the secondary region 4 (comprising the cooling guide roller units 4*a* to 4*d*), i.e., the metallurgical length, required for solidification of the slab is set in match with the high casting speed. In other words, since the sufficiently long metallurgical length is set to enable the slab to be satisfactorily cooled down when the casting speed is high, the length of the secondary cooling region 4 (comprising the guide roller units 4*a* to 4*d*) becomes relatively too long and the slab is cooled down by air or water more than necessary, when the casting speed is slow. In addition, the heat is also removed from the slab through the guide rollers 4A to 4D held in contact therewith. As a result, the slab temperature is excessively lowered when the casting speed is low.

If the length of the guide roller units 4*a* to 4*d*, the amount of water or a mixture of water and air sprayed toward the slab 6, and/or the range in which the guide rollers 4A to 4D are brought into contact with the slab 6 can be changed depending on the casting speed, and the heat of the slab can be kept in a positive manner in a section where the cooling is not effected by the guide roller units, it is possible to avoid the above-mentioned problem that the slab temperature is excessively lowered when the casting speed is low.

In the present invention, therefore, guide roller units 4*a* to 4*d* (cooling zone) are replaced over a required length by the slab lagging covers (heat keeping zone) in a short time depending on the casting speed, thereby positively controlling the cooling rate of the slab 6 so that the temperature of the slab 6 on the entry side of the roughing mill 12 is held at a substantially constant value capable of carrying out the rough rolling. Of course, the cooling spray equipped guide roller units 4*a* to 4*d* and the slab lagging covers can be replaced from one to the other even during the casting operation. Thus, regardless of whether the casting operation is under the pause for each batch or is ongoing, the guide roller units 4*a* to 4*d* and the covers can selectively be set in place for use. As a result, even if the casting speed is changed depending on variations in the amount of molten steel supplied during the continuous casting operation, the respective lengths of the cooling zone and the heat keeping zone can be adjusted simply and quickly to control the cooling rate of the slab.

Figure 4:
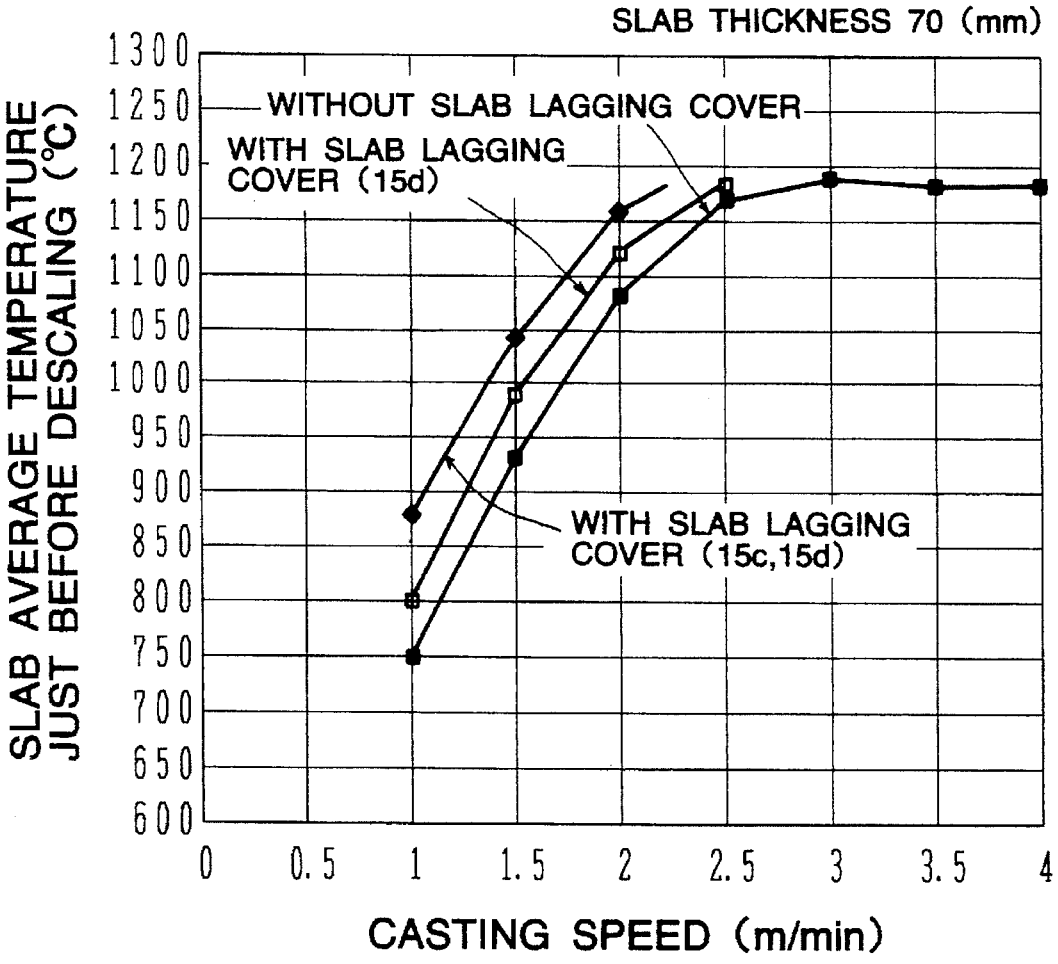
FIG. 4 is a graph showing the relationship between the casting speed and the slab average temperature when one or more slab lagging covers are provided in a secondary cooling region, the graph showing calculation results of the temperature at the position of 16.9 m from the meniscus as with FIG. 3.

FIG. 4 is a graph showing calculation results of the slab average temperature in the embodiment wherein the slab lagging covers are provided in the secondary cooling region 4. As will be seen from FIG. 4, when the slab lagging cover 15*d* is inserted to the zone of the guide roller unit 4*d* (indicated by 15*d* in FIG. 4), a temperature drop of the slab 6 is suppressed to some extent. When the slab lagging covers 15*c* and 15*d* are inserted to the respective zones of the cooling spray equipped guide roller units 4*c* and 4*d* (indicated by 15*c*, 15*d* in FIG. 4), a temperature drop of the slab 6 is further suppressed. Likewise, it is thought that a temperature drop of the slab 6 can be even further suppressed by additionally inserting the slab lagging covers to the respective zones of the cooling spray equipped guide roller units 4*a* and 4*b*. Thus, it will be apparent that a temperature drop of the slab 6 can be suppressed even when the casting speed is 3 m/min or low, by appropriately inserting the slab lagging covers 15*a* to 15*d* case by case.

The illustrated embodiment will now be described in more detail.

Figure 5:
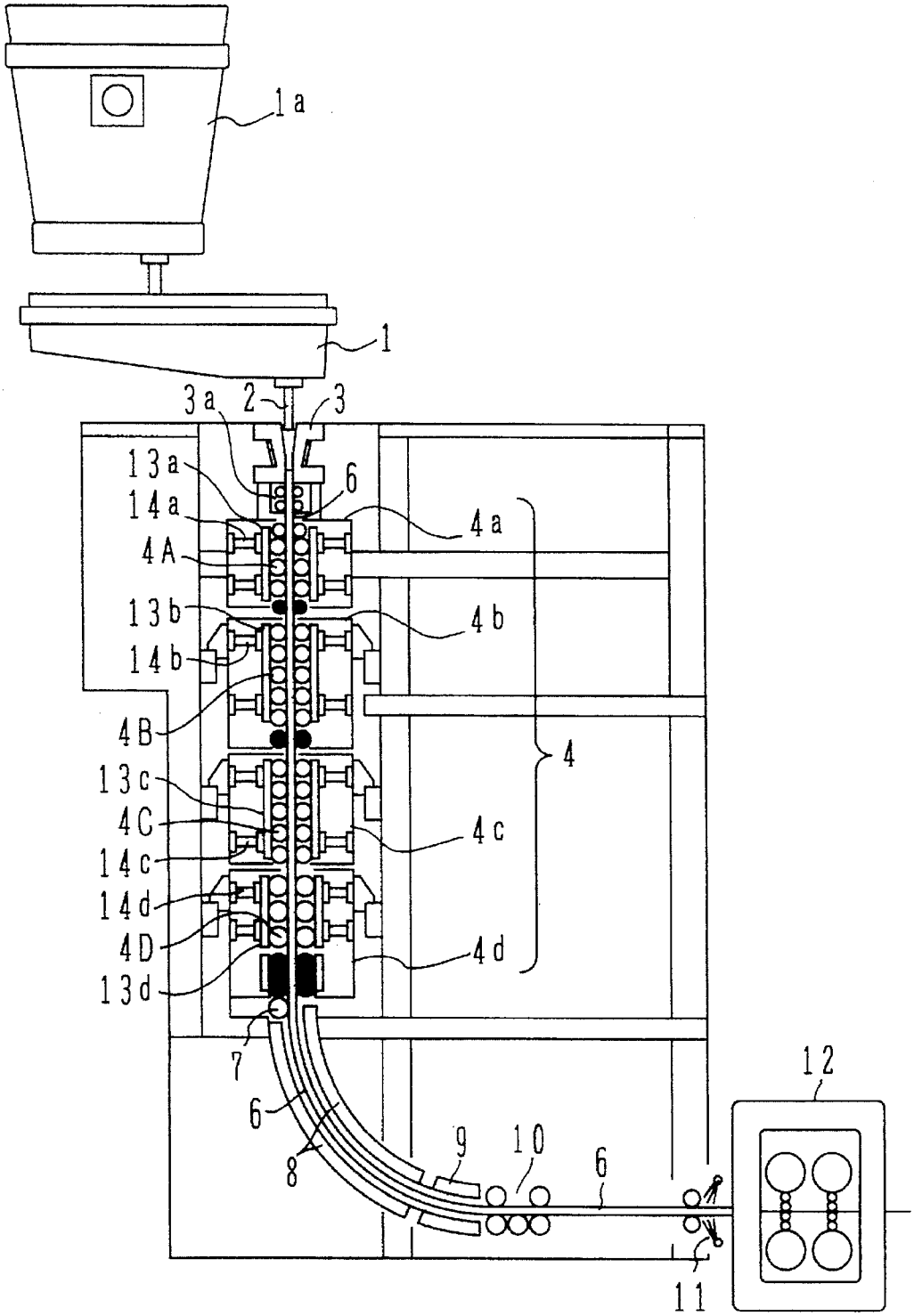
FIG. 5 is a view showing the arrangement in which the thin slab continuous casting machine shown in FIG. 1 is applied to the case that the casting speed is fast.

FIG. 5 is a view showing the arrangement in which the embodiment is applied to the case that the casting speed is fast (not lower than about 3 m/min). In this case, no gaps are formed between the slab 6 and the cooling spray equipped guide roller units 4*a* to 4*d*, and any of the slab lagging covers is not used. The molten metal or steel charged into the mold 3 is cooled down from the surface in the mold 3 to form a solidified shell on the slab surface, thereby defining a cross-section of the slab 6. On the delivery side of the mold 3, the core portion of the slab remains still not solidified. The slab 6 is further cooled down by the cooling spray equipped guide roller units 4*a* to 4*d* in the secondary cooling region 4 so as to complete solidification until the slab core.

The guide roller units 4*a* to 4*d* are constructed by attaching the guide rollers 4A to 4D and the cooling water nozzles 5*a* to 5*d* (see FIG. 1) to guide roller support frames 13*a* to 13*d*, respectively. The guide roller support frames 13*a* to 13*d* are movable back and forth in the direction of thickness of the slab 6 by support frame retractors 14*a* to 14*d* as back-and-forth moving means. The range in which the guide roller support frames 13*a* to 13*d* are movable by the support frame retractors 14*a* to 14*d*, respectively, is set to be greater than the range in which pairs of the guide rollers 4A to 4D facing each other are made movable for adjusting the thickness of the slab 6. Note that, for the sake of simplicity, the cooling water nozzles 5*a* to 5*d* are not shown in FIG. 5.

In the guide roller units 4*a* to 4*d*, those ones of the guide rollers 4A to 4D which are indicated by blank circle marks in FIG. 5 are free rollers, and those ones of the guide rollers 4A to 4D which are indicated by solid circle mark are pinch rollers. The free rollers are movable together with the guide roller support frames 13*a* to 13*d* back and forth in the direction of thickness of the slab 6 by the support frame retractors 14*a* to 14*d*. The gaps to which the slab lagging covers 15*a* to 15*d* are to be inserted are formed between the free rollers and the slab 6. On the other hand, the pinch rollers serve as feed rollers driven to feed the slab 6 or insert a dummy bar instead. The pairs of pinch rollers facing each other are adjustable corresponding to change in thickness of the slab 6. The pinch rollers are disposed in positions out of interference with the slab lagging covers 15*a* to 15*d* and coming into contact with the slab 6 so that the pinch rollers can feed the slab 6 while being pressed against the same without interfering with the back-and-forth movement of the slab lagging covers 15*a* to 15*d*. While the pinch rollers are provided in the cooling spray equipped guide roller units 4*a*, 4*b* and 4*d* in FIG. 5, they may also be provided in the guide roller unit 4*c*.

Figure 6:
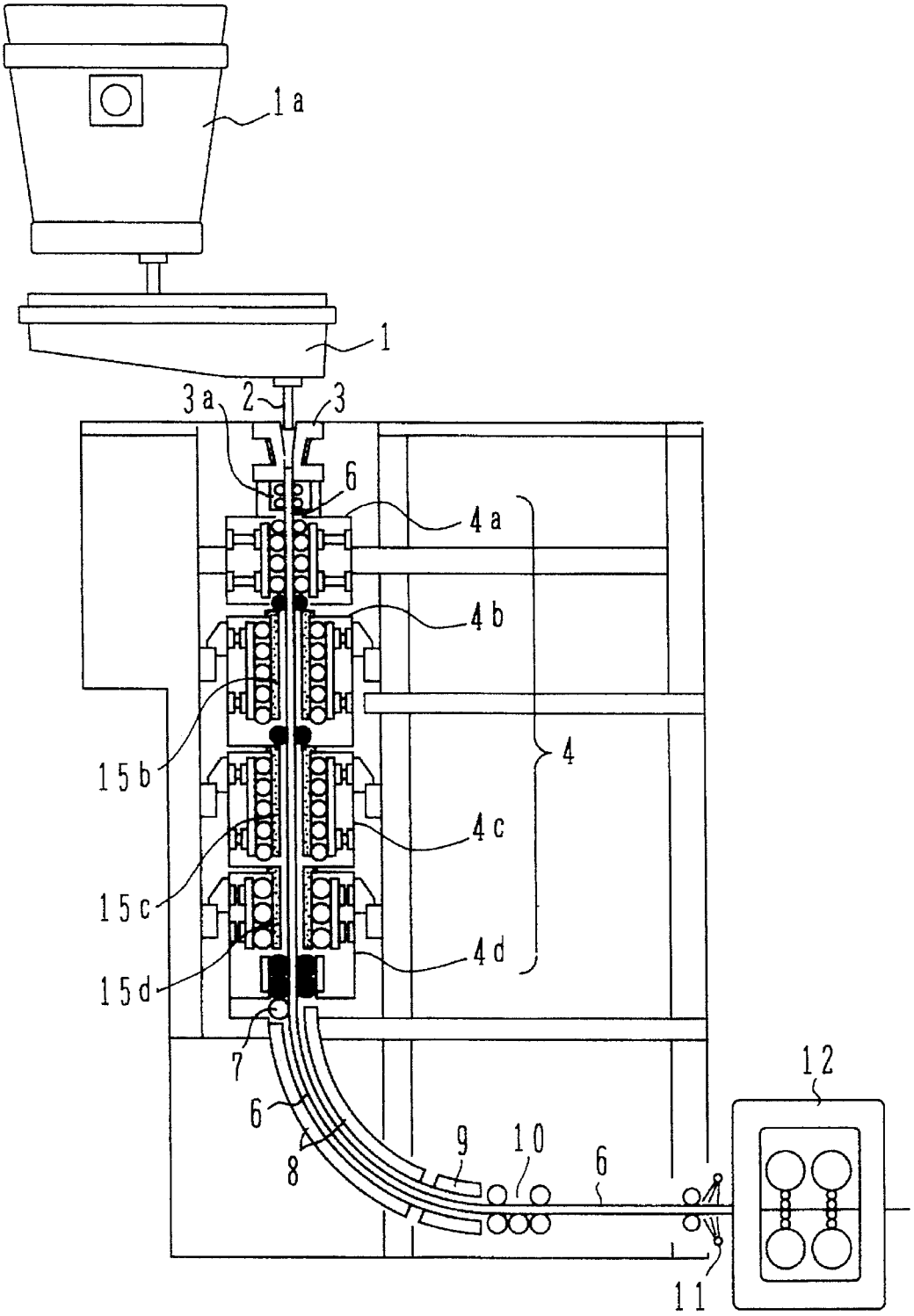
FIG. 6 is a view showing the arrangement in which the thin slab continuous casting machine shown in FIG. 1 is applied to the case that the casting speed is slow.

FIG. 6 is a view showing the arrangement in which the embodiment is applied to the case that the casting speed is slow (not higher than about 3 m/min). In this case, gaps are formed between the slab 6 and the guide roller units 4*b* to 4*d* by moving the guide roller units 4*b* to 4*d* back by the support frame retractors 14*b* to 14*d*, respectively, and the slab lagging covers 15*b* to 15*d* are inserted to the gaps. At this time, the slab lagging covers 15*b* to 15*d* are inserted to positions in front of the guide roller units 4*b* to 4*d*, more exactly, the guide rollers 4B to 4D other than the pinch rollers indicated by solid circle marks, thereby preventing a temperature drop of the slab 6. The replacement of the guide roller units by the slab lagging covers can be made for not only the positions of the cooling spray equipped guide roller units 4*b* to 4*d* as shown in FIG. 6, but also the positions of all the guide roller units 4*a* to 4*d*, the positions of the lower two cooling spray equipped guide roller units 4*c* and 4*d*, or the position of only the lowermost guide roller unit 4*d*. As a result of such selective replacement, when the casting speed is changed depending on variations in the amount of molten steel supplied, the cooling rate of the slab can be controlled in a positive manner by adjusting the respective lengths of the cooling zone and the heat keeping zone in the secondary cooling region 4 depending on the casting speed.

Next, the operation of inserting and withdrawing the slab lagging cover and the sequence of exchanging the cooling spray equipped guide roller unit will be described with reference to FIGS. 7 to 12. Note that, in the following, a description will be made mainly in connection with the slab lagging cover 15*c* and the guide roller unit 4*c*.

FIGS. 7 to 12 are each a side view of the thin slab continuous casting machine of the embodiment shown in FIG. 1, 5 or 6. In each of FIGS. 7 to 12, the left-hand side of the drawing sheet represents the work side and the right-hand side thereof represents the drive side. The guide roller units 4*b* to 4*d* are each indicated by a box, and the pinch roller drivers 40 are shown as being disposed in the drive side. Further, for the sake of simplicity, the arrangements for exchanging the uppermost guide roller units 4*a* by the slab lagging covers are omitted.

Figure 7:
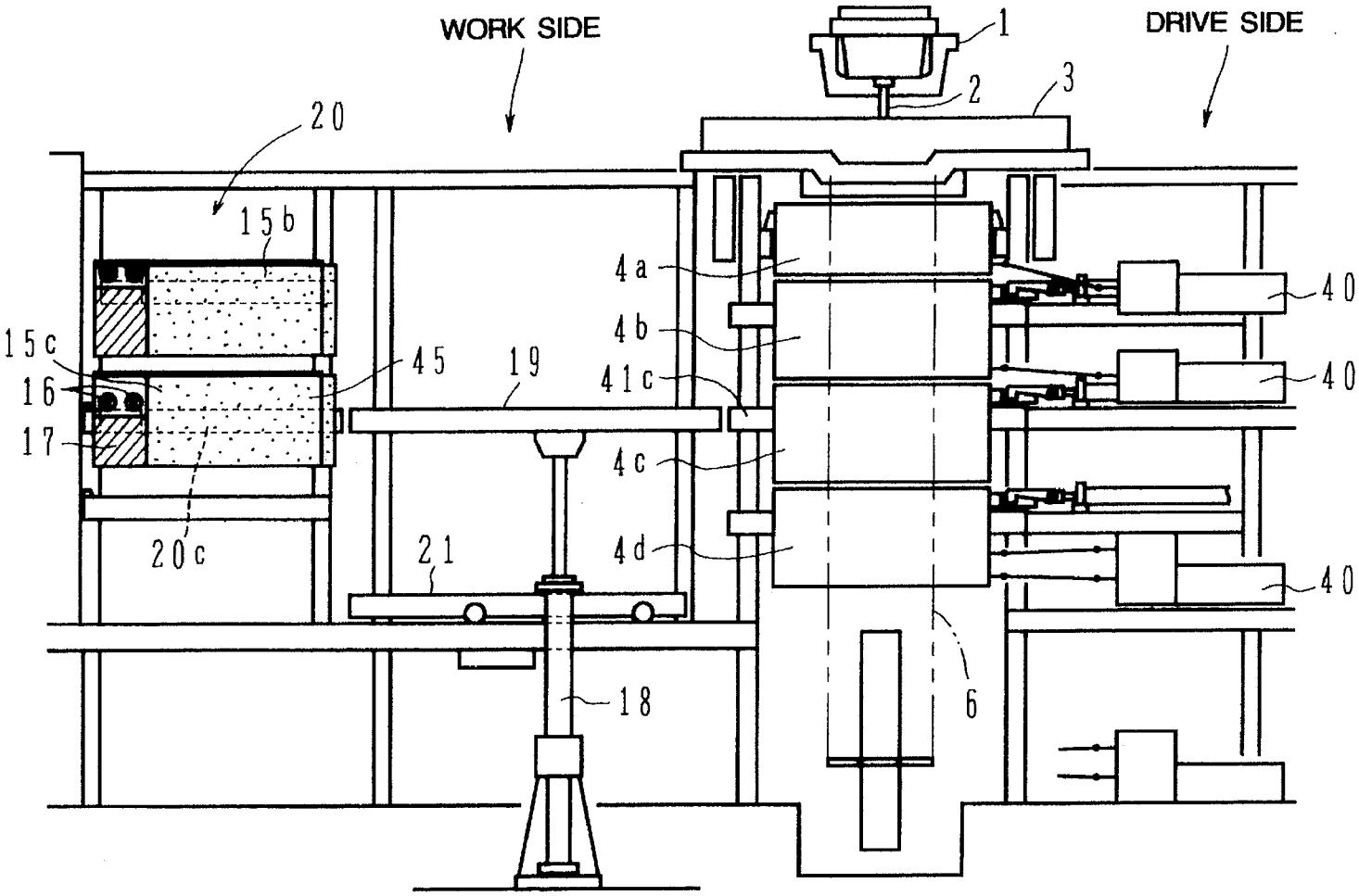
FIG. 7 is a side view of the thin slab continuous casting machine shown in FIG. 1, 5 or 6, the view showing the state where the slab lagging covers are held in standby positions and not in use.

As shown in FIG. 7, the slab lagging cover 15*c* is filled with a heat insulation material 45 and has wheels 16 which are attached to one side of the cover 15*c*, i.e., the side near the work side, and are driven by a motor (not shown). Also, a counterweight 17 is attached to the slab lagging cover 15*c* at a position near the wheels 16 for well-balanced structure. The slab lagging cover 15*c* is standing by on a fixed rail 20*c* in a standby position 20 when not used. The height of the fixed rail 20*c* is the same as that of a fixed rail 41*c* right below the casting position.

On the other hand, an elevator rail 19 can be moved up and down by an exchange elevator 18. With the vertical movement, the elevator rail 19 can be aligned with the fixed rail 20*c* and the fixed rail 41*c*. By driving the wheels 16 to run on the fixed rail 20*c* and the elevator rail 19 in the condition where the elevator rail 19 is aligned with the fixed rail 20*c* and the fixed rail 41*c*, the slab lagging cover 15*c* is moved in the direction indicated by arrow in FIG. 8 and then inserted to the gap between the slab 6 and the guide roller unit 4*c* for setting into the center position relative to the path of the slab.

Figure 8:
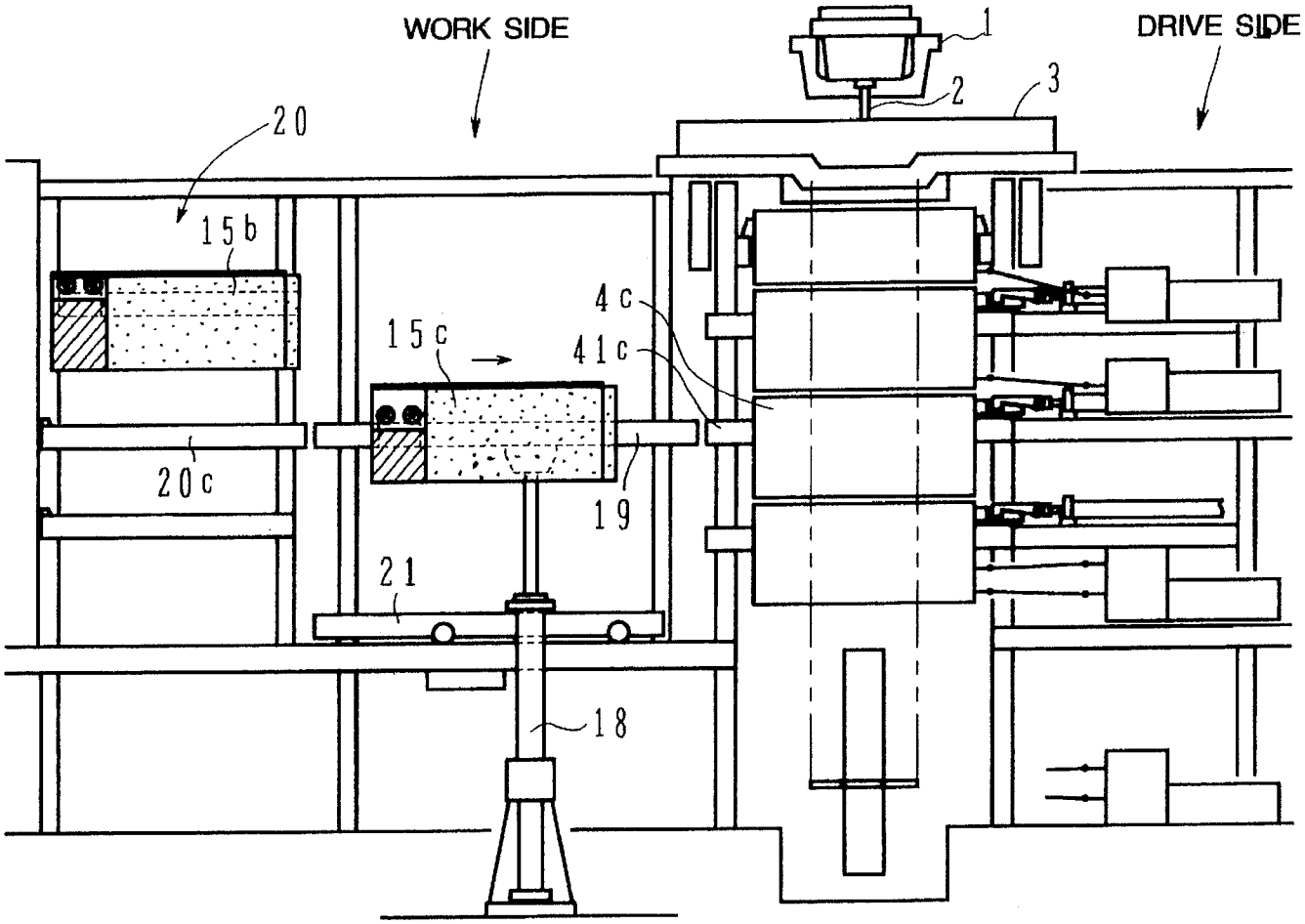
FIG. 8 is a view showing the state where one slab lagging cover is being moved from the position of FIG. 7 for insertion to a gap between the slab and a cooling spray equipped guide roller unit.
Figure 9:
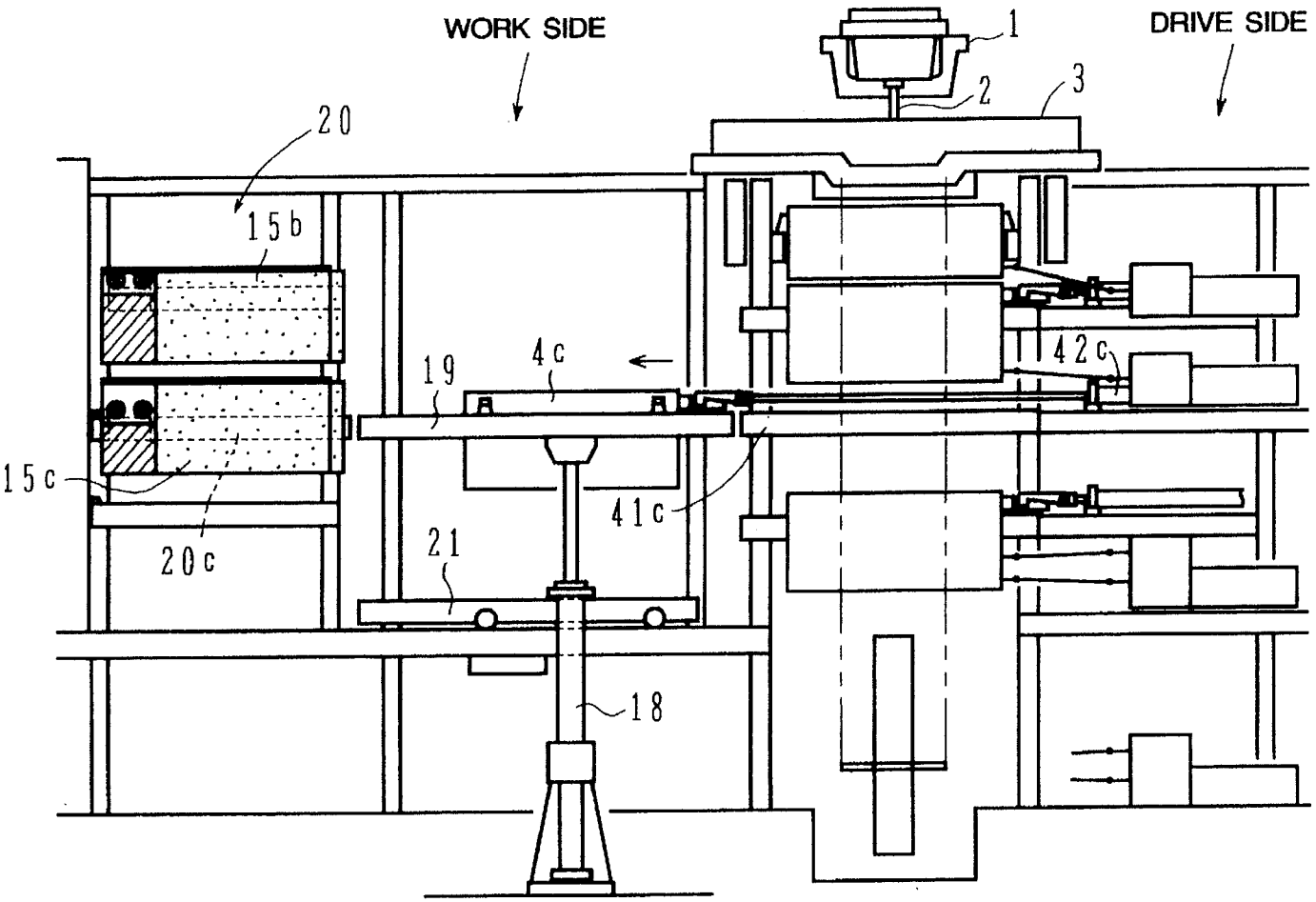
FIG. 9 is a view showing the state where a guide roller unit equipped with the cooling spray is pushed out onto an elevator rail when it is removed or exchanged for maintenance or other reason.
Figure 10:
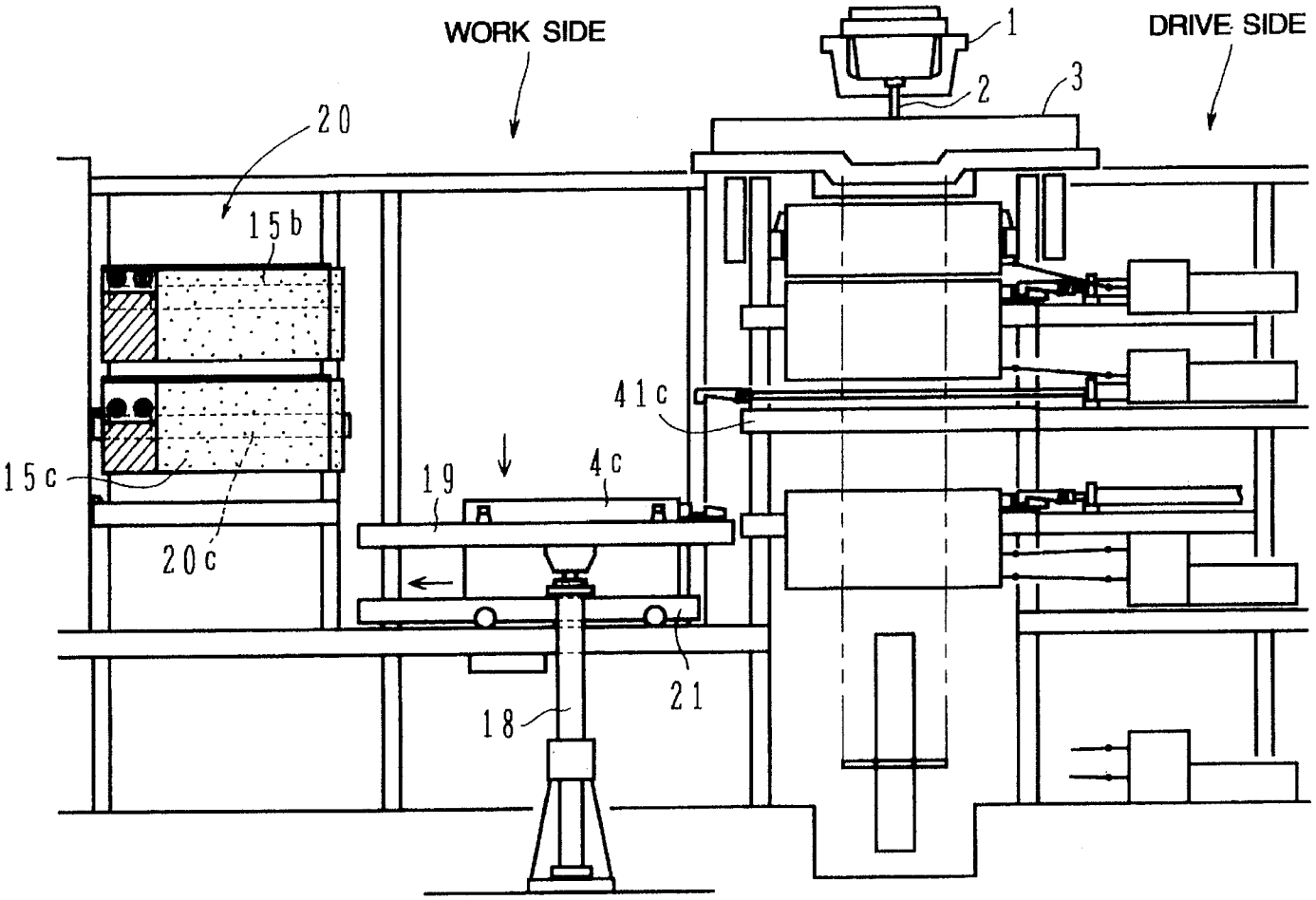
FIG. 10 is a view showing the state where an exchange elevator is operated to place the cooling spray equipped guide roller unit on an exchange carriage.

Further, the guide roller unit 4*c* is positioned on the fixed rail 41*c* during the normal casting operation as shown in FIG. 7 and 8, but the guide roller unit 4*c* is pushed out onto the elevator rail 19 on the work side by a cylinder 42*c* provided in the pinch roller driver 40 on the drive side, as shown in FIG. 9, when it is removed or exchanged for maintenance or other reason or not in use. Then, the exchange elevator 18 is operated to descend so that the guide roller unit 4*c* is placed on an exchange carriage 21. After that, the guide roller unit 4*c* is carried with the exchange carriage 21 to a certain maintenance shop (not shown). The newly prepared cooling spray equipped guide roller unit 4*c* having finished the maintenance work or the like is set in place through the reversed process to the above.

Figure 11:
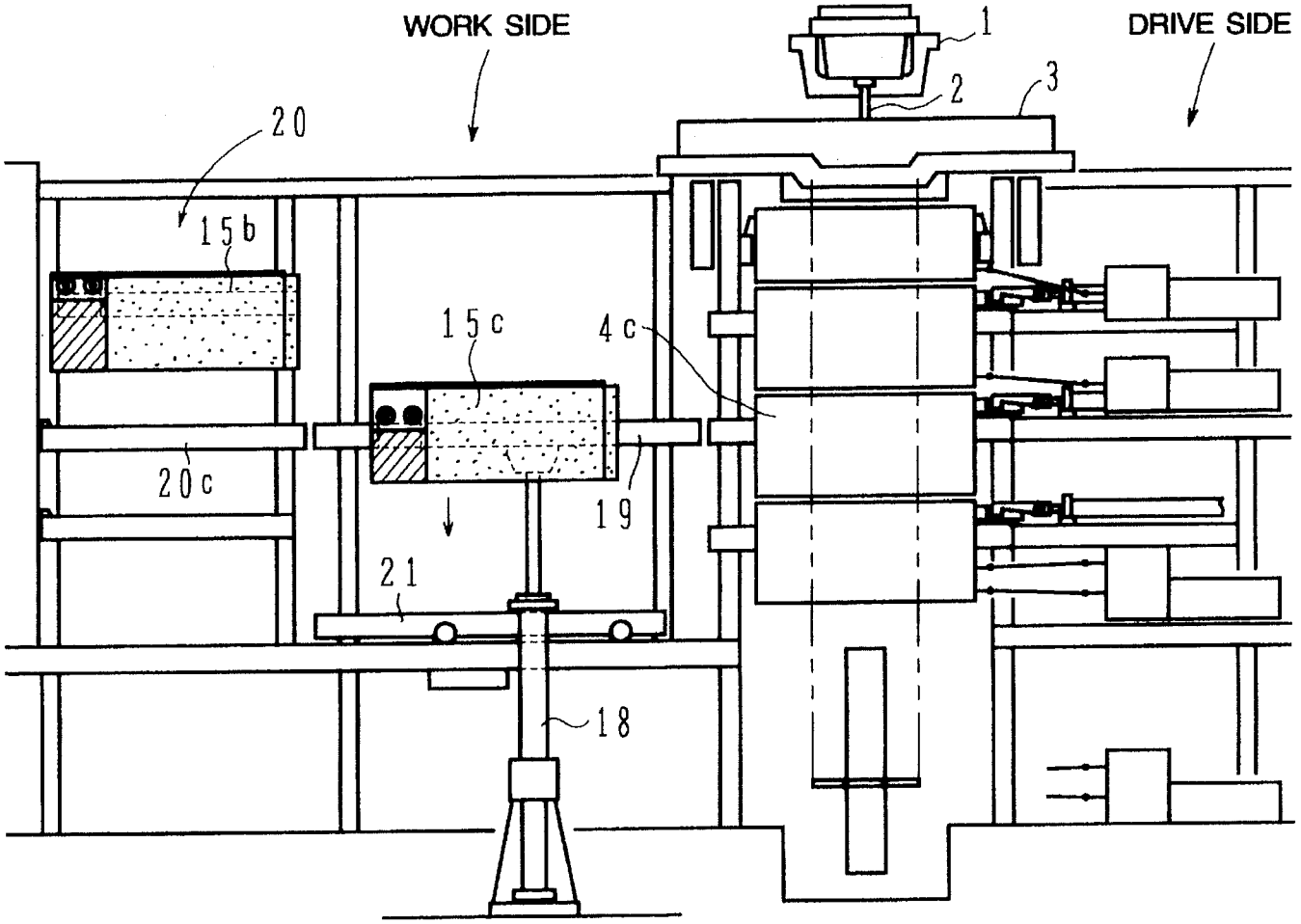
FIG. 11 is a view showing the state where only the slab lagging cover is solely exchanged by using the exchange elevator.

FIG. 11 is a view showing the state where only the slab lagging cover 15*c* is solely exchanged by using the exchange elevator 18. For this exchange, in the condition where the elevator rail 19 is aligned with the fixed rail 20*c* and the fixed rail 41*c*, the slab lagging cover 15*c* is moved onto the elevator rail 19. Thereafter, although the process is not shown, the exchange elevator 18 is operated to place the slab lagging cover 15*c* on the exchange carriage 21, and the slab lagging cover 15*c* is carried to the certain maintenance shop by the exchange carriage 21 as with the case of FIG. 10. The newly prepared slab lagging cover 15*c* having finished the maintenance work or the like is set in place through the reversed process to the above.

Figure 12:
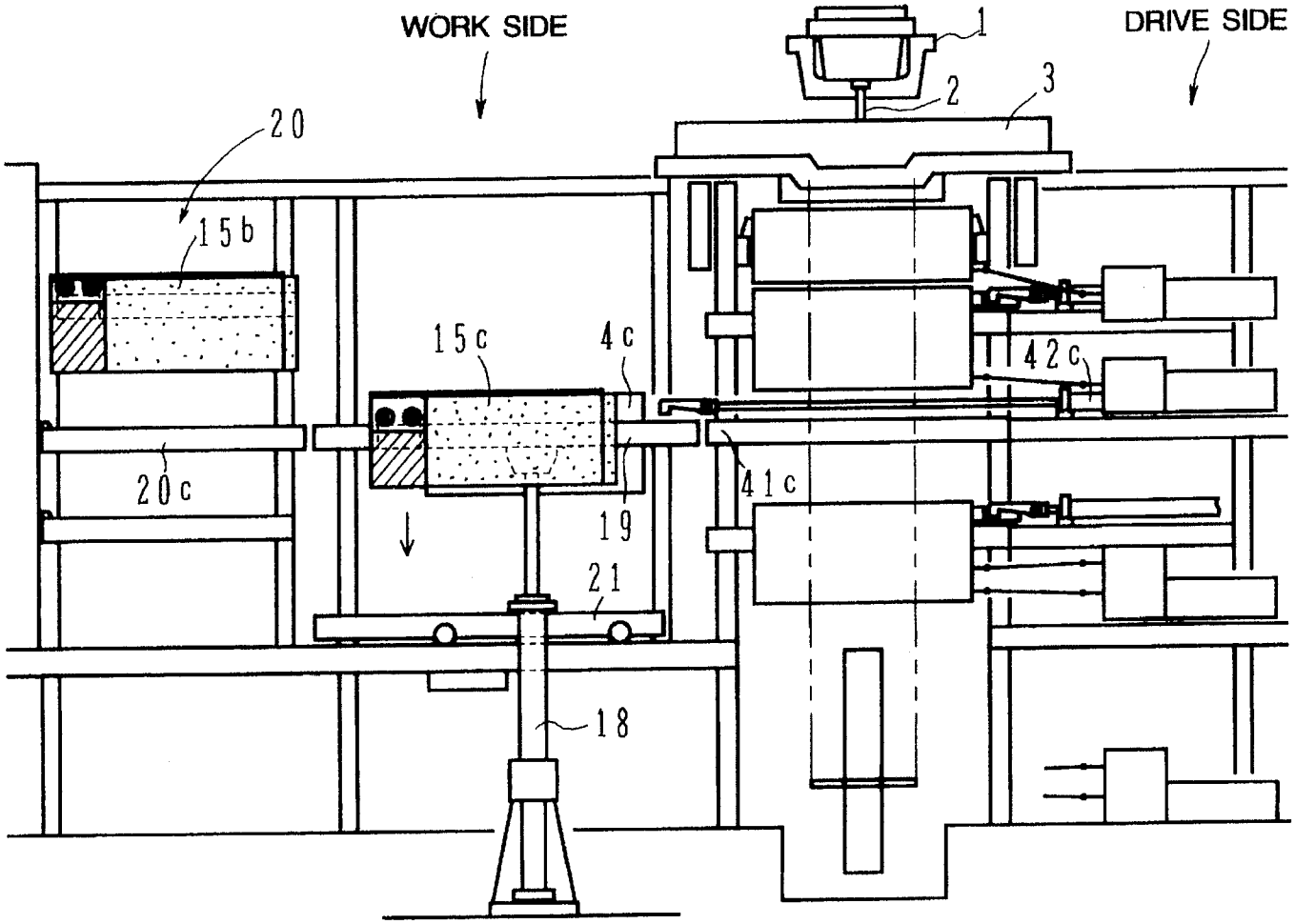
FIG. 12 is a view showing the state where the slab lagging cover is inserted to the inner side of the guide roller unit and both the members are then exchanged in that assembled state.

FIG. 12 is a view showing the state where the slab lagging cover 15*c* is inserted to the inner side of the guide roller unit 4*c* and both the members are then exchanged by using the exchange elevator 18 in that assembled state. As shown in FIG. 12, the guide roller unit 4*c* and the slab lagging cover 15*c* are pushed out together in the assembled state onto the elevator rail 19 by the cylinder 42*c*. Thereafter, the exchange elevator 18 is operated to place the guide roller unit 4*c* and the slab lagging cover 15*c* on the exchange carriage 21, and the guide roller unit 4*c* and the slab lagging cover 15*c* are both carried to the certain maintenance shop (not shown) by the exchange carriage 21 as with the case of FIG. 10. The newly prepared guide roller unit 4*c* and slab lagging cover 15*c* having finished the maintenance work or the like are set in place through the reversed process to the above.

In the foregoing arrangements, the exchange elevator 18, the elevator rail 19, the fixed rail 20*c*, the fixed rail 41*c*. etc. serve to not only as means for inserting and withdrawing the slab lagging covers, but also as means for withdrawing the guide roller units or the slab lagging covers. Also, the cylinder 42*c*, etc. serve as part of the means for withdrawing the guide roller units or the slab lagging covers.

Incidentally, the foregoing arrangements for the operation of inserting and withdrawing the slab lagging covers and the sequence of exchanging the guide roller units equipped with cooling spray may be provided in the drive side shown as being on the right-hand side in the drawings.

With the embodiment explained above, since the guide roller units 4*a* to 4*d* and the slab lagging covers 15*b* to 15*d* are replaced from one to the other for selective use in the secondary cooling zone 4, the cooling rate of the slab 6 can be controlled in a positive manner by adjusting the respective lengths of the cooling zone and the heat keeping zone in the secondary cooling region 4 depending on the casting speed. Furthermore, the replacement between the two members can be made simply and quickly. Accordingly, the temperature of the slab 6 on the entry side of the roughing mill 12 can be held at a substantially constant value capable of carrying out the rough rolling. In particular, when the casting speed is slow (e.g., not higher than 3 m/min), the heat of the slab is positively kept by the slab lagging covers 15*b* to 15*d* and, therefore, the temperature of the slab 6 is prevented from reducing to an excessively low value at which the rough rolling cannot be performed.

Also, since the caster is arranged such that the slab is fed along a vertical straight line from the mold 3 to the lower end of the secondary cooling region 4, it is possible to prevent the extent that the slab is cooled down from differing in a cross-section of the slab 6, and to hold the temperature of the slab 6 even over its cross-section.

Further, since the guide roller units 4*a* to 4*d* and the slab lagging covers 15*b* to 15*d* are replaced from one to the other for selective use during the casting operation, the cooling rate of the slab can be controlled simply and quickly by adjusting the respective lengths of the cooling zone and the heat keeping zone when the casting speed is changed depending on variations in the amount of molten steel supplied during the continuous casting operation.

Consequently, the continuous caster of the present invention can optionally be adapted for not only the operation under the casting speed of 3 to 6 m/min that has been practiced in conventional continuous casters for producing thin slabs with a thickness not larger than 100 mm, but also the operation under the lower casting speed of 1.5 to 3 m/min. As a result, a hot rolling mill system in which steps from continuous casting to finish rolling are performed in a through line, i.e., a continuous casting—hot rolling—through line (or direct-feed) system, can be realized even in the case of producing various grades of steel in small quantity, or the case that the amount of molten steel supplied varies.

As described hereinabove, according to the present invention, since the guide roller units equipped with cooling spray and the slab lagging covers are replaced from one to the other for selective use, the cooling rate of the slab can be controlled in a positive manner. In addition, the replacement between the two members can be made simply and quickly. Accordingly, the temperature of the slab before the rough rolling can be held at a substantially constant value capable of carrying out the rough rolling. In particular, when the casting speed is slow, the heat of the slab is positively kept by the slab lagging covers and, therefore, the temperature of the slab is prevented from reducing to an excessively low value at which the rough rolling cannot be performed.

Also, since the caster is arranged such that the slab is fed along a vertical straight line from the mold to the lower end of the secondary cooling region, it is possible to hold the temperature of the slab even over its cross-section.

Further, since the guide roller units equipped with cooling spray and the slab lagging covers are replaced from one to the other for selective use during the casting operation, the cooling rate of the slab can be controlled simply and quickly when the casting speed is changed depending on variations in the amount of molten steel supplied during the continuous casting operation.

Consequently, the continuous caster of the present invention can optionally be adapted for not only the casting speed that has been practiced in conventional continuous casters for producing thin slabs with a thickness not larger than 100 mm, but also the lower casting speed. As a result, a hot rolling mill system in which steps from continuous casting to finish rolling are performed in a through line, i.e., a continuous casting—hot rolling—through line (or direct-feed) system, can be realized even in the case of producing various grades of steel in small quantity, or the case that the amount of molten steel supplied varies.

What is claimed is:

1. A thin slab continuous casting machine comprising a mold for casting molten metal and a secondary cooling region for cooling and solidifying a slab cast in said mold while feeding said cast slab, thereby continuously casting a slab with a thickness not larger than 100 mm, wherein:

said secondary cooling region consists of a plurality of sections, and at least one of said sections includes a guide roller unit equipped with cooling spray comprising guide rollers for feeding said slab and cooling sprays for cooling said slab, a slab lagging cover for preventing a temperature drop of said slab, and replacement means for selectively replacing said guide roller unit and said slab lagging cover from one to the other.

2. A thin slab continuous casting machine according to claim 1, wherein said mold and all of said sections in said secondary cooling region are disposed along a vertical straight line.

3. A thin slab continuous casting machine according to claim 1, wherein said replacement means includes back-and-forth moving means for moving at least part of said guide rollers of said guide roller unit back and forth in the direction of thickness of said slab, and inserting/withdrawing means for inserting said slab lagging cover to a gap formed between said slab and the part of said guide rollers which is moved back by operation of said back-and-forth moving means, and withdrawing said slab lagging cover from said gap.

4. A thin slab continuous casting machine according to claim 3, wherein said guide roller unit includes pinch rollers disposed in positions out of interference with said slab lagging cover and coming into contact with said slab so that said pinch rollers can feed said slab while pressing said slab without interfering with the back-and-forth movement of said slab lagging cover, and free rollers movable by said back-and-forth moving means back and forth in the direction of thickness of said slab.

5. A thin slab continuous casting machine according to claim 1, wherein said replacement means further includes withdrawing means for withdrawing at least one of said guide roller unit and said slab lagging cover to a work side or a drive side when said secondary cooling region is under maintenance work or not in use.

6. A thin slab continuous casting method comprising the steps of casting molten metal in a mold, and cooling and solidifying a cast slab in a secondary cooling region while feeding said cast slab through said secondary cooling region, thereby continuously casting a slab with a thickness not larger than 100 mm, wherein said secondary cooling region comprising a plurality of sections, and at least one of said sections includes a guide roller unit equipped with cooling spray comprising guide rollers for feeding said slab and cooling sprays for cooling said slabs, and a slab lagging cover for preventing a temperature drop of said slab, wherein the continuous casting method further comprising a step of selectively replacing said guide roller unit and said slab lagging cover from one to the other depending on casting speed of the slab to adjust a cooling rate of said slab so that slab temperature is kept at a value capable of carrying out subsequent rough rolling of the slab.

* * * * *